United States Patent [19]

Michot

[11] Patent Number: 4,850,894

[45] Date of Patent: Jul. 25, 1989

[54] RESTRAINING RECEPTACLE

[75] Inventor: Alain F. Michot, Cary, N.C.

[73] Assignee: Northern Telecom Limited, Montreal, Canada

[21] Appl. No.: 212,790

[22] Filed: Jun. 29, 1988

[51] Int. Cl.[4] ..... H01R 13/627

[52] U.S. Cl. ..... 439/355; 439/357

[58] Field of Search ..... 439/55, 78, 83, 350, 439/355, 356, 357, 358

[56] References Cited

U.S. PATENT DOCUMENTS

| | | | |
|---|---|---|---|
| 4,553,801 | 11/1985 | Zajeski | 439/595 |
| 4,589,718 | 5/1986 | Szczesny | 439/571 |
| 4,667,270 | 5/1987 | Yagi | 439/356 |

OTHER PUBLICATIONS

IBM Bulletin, Pinter, vol. 20, No. 1, p. 88, 6-1977.

*Primary Examiner*—Neil Abrams

*Assistant Examiner*—Khiem Nguyen

*Attorney, Agent, or Firm*—Foley & Lardner, Schwartz, Jeffery, Schwaab, Mack, Blumenthal & Evans

[57] ABSTRACT

A receptacle for receiving and restraining shoulder type connectors is disclosed. It is comprised of an inner frame member for mating with the connectors. It has first and second oppositely positioned retaining walls spaced to be a sliding fit over the connector. A base extends between the first and second walls and is provided with recess means for receiving terminal means. The recess means allow the terminal means to extend therefrom to permit mating with the connector sockets. An outer frame member can be provided for imparting rigidity to the inner frame member. The outer frame is comprised of a first side wall extending upwardly from the base along the first retaining wall and a second side wall extending upwardly from the base along the second retaining wall.

8 Claims, 2 Drawing Sheets

RESTRAINING RECEPTACLE

This invention relates to socket type terminals, which accept pin and similar type terminals, particularly as are used in telecommunications systems to interconnect circuit boards, connect circuit boards to backplanes, and similar arrangements.

The developments in silicone technology have resulted in an increase in the density of integrated circuits, an increase in the speed of signal transmission, and an increase in functionality of devices. This in turn has created stringent requirements in the interconnection field to provide connectors with a small size, a high number of contacts and a low mating or insertion force. However, these requirements are contradictory and connectors with more than two hundred terminals have been marginal in performance, and in fact connectors with less than two hundred terminals often do not give adequate or acceptable performance. This is because of various factors, such as: (a) the contact normal force required to provide and maintain a reliable connection has been sacrificed in order to provide low insertion force; (b) connectors providing the zero, or very low, insertion forces have been very complex and expensive; (c) the relatively large size has not been conducive to either dense packaging or package size reduction; and (d) connectors with several hundred terminals have the inherent problem of loosening up due to the excessive weight of the cable or technicians brushing past the back panel.

By a contact normal force is meant the force exerted between two contacting surfaces in a direction normal to the contact plane.

The present invention provides a receptacle which is used to hold in place a shouldered connector, such as a level five connector without the help of additional fasteners. The receptacle is fastened to a back panel and the wired shoulder connector is guided into place by the receptacle's vertical tabs. The force applied by the connectors spreads the tabs until the connector reaches its final location, at which point the tabs snap over the shoulders of the connector to keep it in place. The connector may be disengaged from the receptacle by pulling on the connector, thereby spreading the connector's tabs and freeing the connector. This prevents the connector from working loose and hence provide and maintain a reliable connection.

The receptacle is provided with an outer plastic frame designed to increase the rigidity of the receptacle so that the weight of the cable will not cause the receptacle to buckle, or bend whenever several connectors are disengaged (which can require a significant amount of force).

According to a first aspect of the present invention, there is provided a receptacle for receiving and restraining shoulder type connectors, comprising: an inner frame member for mating with said connector, said member having first and second oppositely positioned retaining walls spaced to be a sliding fit over said connector; a base extending between first and second walls; and recess means on said base for receiving terminal means, said recess means allowing said terminal means to extend therefrom so as to permit mating with the socket means of said connector.

According to a second aspect of the present invention there is provided a receptacle for receiving and restraining shoulder type connectors, comprising: an inner frame member for mating with said connector, said member having first and second oppositely positioned retaining walls spaced to be a sliding fit over said connector, a base extending between said first and second walls and recess means on said base for receiving terminal means, said recess means allowing said terminal means to extend therefrom so as to permit mating with socket means of said connector; and an outer frame member for imparting rigidity to said inner frame member, said outer frame member being comprised of a first side wall extending upwardly from said base along said first retaining wall and a second side wall extending upwardly from said base along said second retaining wall.

The invention will be readily understood by the following description of one form of terminal and a connector for use with the terminal, by way of example, in conjunction with the accompanying drawings, in which.

Figure 1:
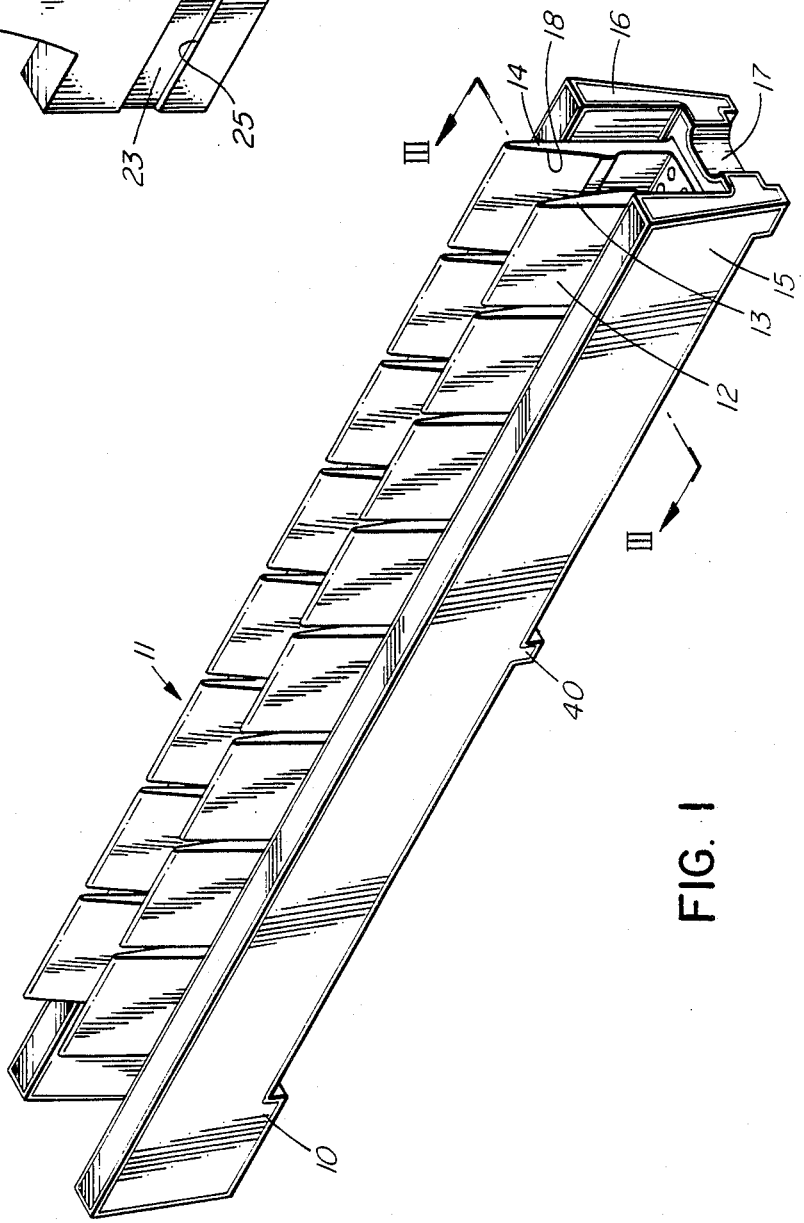
FIG. 1 is an isometric view of the receptacle of the present invention.

FIG. 1 illustrates the receptacle of the present invention. It is comprised of an outer frame member 10 and an inner frame member 11. In order to ease insertion of a connector, the inner frame member 11 is subdivided into a plurality of sub-sections 12, each sub-section consists of a pair of oppositely positioned retaining tabs 13 and 14 which are spaced apart in order to provide a sliding fit for a connector. Each tab is provided with an inwardly extending rib 18 adapted to mate with a shouldered edge of the connector.

The outer frame member 10 imparts rigidity to the inner frame member 11 to prevent the buckling of the receptacle when loaded with cables. The outer frame member 10 is provided with a first and second side wall 15 and 16 respectively, which extend from base 17 along the first and second set of tabs 13 and 14. This receptacle can be conveniently molded of plastic.

Figure 2:
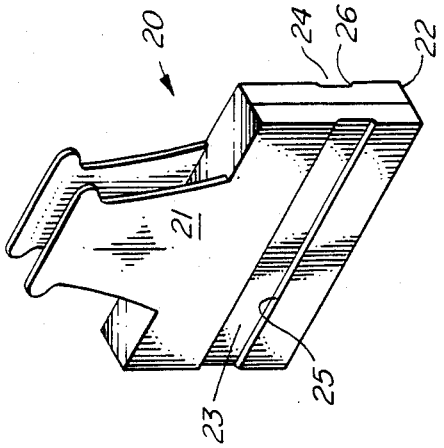
FIG. 2 is an isometric view of the shouldered type connector for use with the present invention.

At reference numeral 20 of FIG. 2 we have shown an isometric view of a shoulder type connector to be used with the receptacle of the present invention. This type of connector is provided with an outer frame member 21 having a plurality of recesses or socket terminals (not shown) extending inwardly at base 22.

Positioned on the outer walls of frame member 21 are longitudinal grooves 23 and 24 having inclined shoulder surfaces 25 and 26 respectively adapted to mate with the ribs of the retaining tabs of inner frame member 11.

Figure 3:
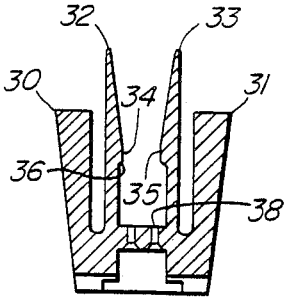
FIG. 3 is a sectional view taken along line 3—3 of FIG. 1.

Referring now to FIG. 3 we have shown a sectional view of the receptacle taken along lines 3—3 of FIG. 1. As can be more clearly seen, the side walls 30 and 31 extend parallel to tabs 32 and 33 respectively but are spaced apart a predetermined distance to allow tabs 32 and 33 to be spread apart when the connector is guided into place.

Each retaining tab is provided with inwardly extending ribs 34 and 35 for mating a shouldered edge of a connector. In addition, the ribs are provided with inclined surfaces shown at 36 to allow easier removal of the connector. Also, each recess is comprised of a series of apertures 38 which extend through the base for receiving pin terminals adapted to extend therefrom to be received by the socket terminals of the connector.

Figure 4:
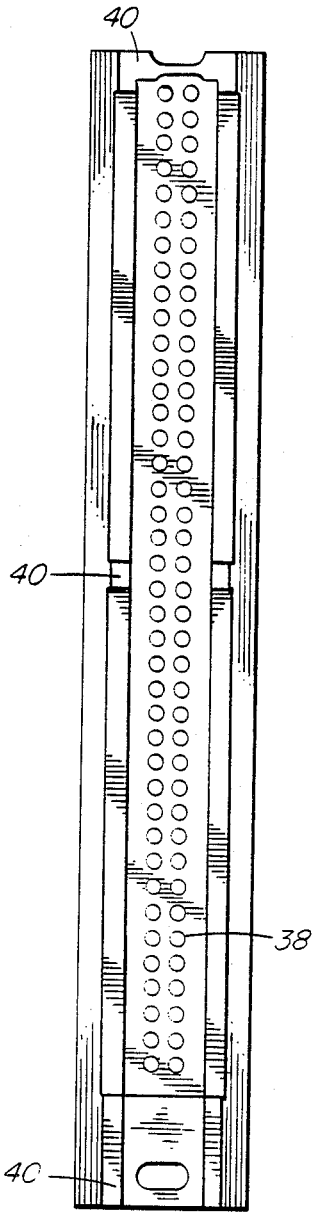
FIG. 4 is a bottom view thereof.

As shown in FIG. 4, the recesses extend longitudinally along the receptacle and are positioned in pairs. Extending beyond the base of the receptacle are a number of supporting feet 40 which provides a space between the base and the surface on which the receptacle is mounted. This space allows insertion of wrap-around connectors which may be attached to one or any number of pin terminals to allow testing and the like.

Figure 5:
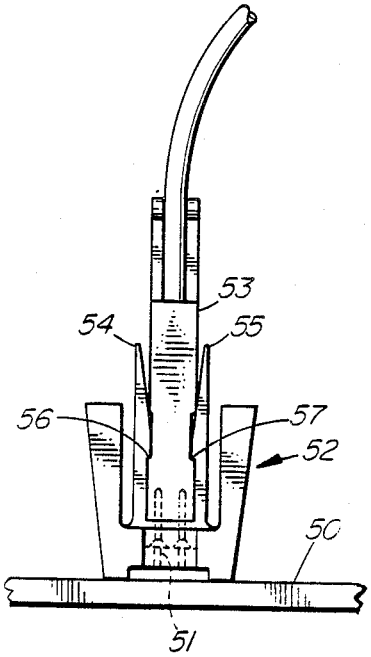
FIG. 5 is a partially sectioned view of the receptacle as it would be used with the shouldered connector.

Referring now to FIG. 5, we have shown an illustrative partially sectioned view of the receptacle of the present invention retaining a shoulder type connector. In this embodiment, a typical backplane is indicated at reference numeral 50. A plurality of pin terminals 51 have been inserted into the recesses or apertures of receptacle 52. A shoulder type connector 53 has been inserted between guiding tabs 54 and 55 respectively. At this position, the connector has reached its final location at which point the tabs 54 and 55 have snapped back over the shoulders 56 and 57 respectively of connector 53 to keep it in place. The connector may be disengaged from the receptacle by pulling on the connector thereby spreading the connector tabs 54 and 55 apart and freeing the connector.

What is claimed is:

1. A receptacle for receiving and retaining shoulder type connectors, comprising:

an elongated base having a plurality of recess means for receiving a plurality of connecting pins; a plurality of retaining tabs arranged in pairs, extending upwardly from said base, each pair comprising oppositely positioned tabs, each pair being spaced apart from an adjacent pair so as to be operatively independent from one another, each tab being disposed longitudinally along said base such that said pairs form an open channel therealong providing a sliding fit with said connectors;

and an elongated outer frame member for imparting rigidity to said retaining tabs, said outer frame member having a first and second side wall extending upwardly from said base, and longitudinally along said pairs of tabs.

2. A receptacle as defined in claim 1, wherein said base is further comprised of supporting feet extending below said base and adapted to elevate said base from a support surface to provide a space therebetween, thereby allowing access to said connecting pins.

3. A receptacle as defined in claim 2, wherein said base is further comprised of a cavity extending below said base and along the longitudinal length thereof, said cavity allowing insertion of wire wrapping leads or connectors to said connecting pins.

4. A receptacle as defined in claim 3, wherein said tabs further comprise inwardly extending ribs for mating and retaining a shouldered edge of said connector.

5. A receptacle as defined in claim 4, wherein said ribs have inclined surfaces to allow easier removal of said connectors.

6. A receptacle as defined in claim 5, wherein said recess means comprises a plurality of apertures which extend through said base for receiving a plurality of pin terminals adapted to extend therefrom to be received by socket terminals of said connector.

7. A receptacle as defined in claim 6, wherein said first and second side wall of said elongated outer frame member is each comprised of an interior face extending upwardly and longitudinally along said tabs and a slanted exterior face extending upwardly, outwardly and longitudinally along said base.

8. A receptacle for receiving and retaining shoulder type connectors comprising:

an inner frame member said inner frame member having:

an elongated base with recess means for receiving a plurality of connecting pins;

a plurality independently operable retaining tabs arranged longitudinally along said elongated base in pairs on opposite sides of a plurality of said recess means in said base, each said retaining tab extending upward from said base and having an inner surface and an outer surface;

each said inner surface of each said retaining tab of each of said pairs further having an inwardly extending rib with an upwardly and inwardly inclined bottom surface located a distance above said base, each said rib facing a corresponding rib of said pair, forming a retaining channel;

each said inner surface extending upwardly and outwardly above said channel to intersect each said outer surface.

* * * * *